US005230909A

United States Patent [19]

Stanly

[11] Patent Number: 5,230,909

[45] Date of Patent: Jul. 27, 1993

[54] APPARATUS FOR FORMING MINIATURE POTTERY

[76] Inventor: Alan H. Stanly, 6921 Chestnut Dr., Huntington Beach, Calif. 92647

[21] Appl. No.: 877,537

[22] Filed: May 1, 1992

[51] Int. Cl.[5] ..... B28B 1/02; B28B 1/08; B28B 1/29

[52] U.S. Cl. ..... 425/183; 425/263; 425/432; 425/456; 425/459

[58] Field of Search ..... 425/459, 263, 267, 456, 425/432, 425, 183, 264, 265, 266, 268, 458; 264/310

[56] References Cited

U.S. PATENT DOCUMENTS

| | | | |
|---|---|---|---|
| 3,222,747 | 12/1965 | Meadows et al. | 25/24 |
| 3,605,218 | 9/1971 | Rasmussen et al. | 25/24 |
| 3,995,983 | 12/1976 | Shenker | 425/459 |
| 4,028,041 | 6/1977 | Zambrano, Jr. | 425/459 |
| 4,061,460 | 12/1977 | George | 425/459 |
| 4,102,622 | 7/1978 | Simpson | 425/459 |
| 4,332,542 | 6/1982 | Matsui | 425/459 |
| 4,585,240 | 4/1986 | Giffin | 425/459 |
| 4,689,001 | 8/1987 | Yoder | 425/183 |
| 4,702,920 | 10/1987 | Goodman | 425/459 |

*Primary Examiner*—Jay H. Woo

*Assistant Examiner*—Khanh P. Nguyen

[57] ABSTRACT

An apparatus is provided for forming a miniature pot. A pottery wheel has a diameter no larger than two inches and rotates about a vertical axis. The wheel has a facing flat surface for supporting the miniature pot. A motor is coupled to the wheel for rotating the wheel about the axis at an adjustable rotational speed of between 200 and 10,000 revolutions per minute. A support base contains the motor and further includes a power source. The wheel extends above the base, and preferably includes the rotor portion of the motor. The wheel further includes a disk shaped platform and a support shaft. The platform is disengagable from the shaft so that a replacement platform may be engaged with the shaft. The platform further includes a clay preform attached to the surface of the platform. The apparatus is preferably small and light weight enough so that it may be supported by a hand and easily carried therein. A switch is also included that breaks the circuit between the motor and the power source, thereby allowing manual braking of the wheel for slowing wheel rotation. A vibrator is further included that produces lateral vibrational excursions of the platform. The vibrator allows special effects to be molded into the pot by producing lateral pot movements while the pot is rotating.

7 Claims, 2 Drawing Sheets

APPARATUS FOR FORMING MINIATURE POTTERY

FIELD OF THE INVENTION

This invention relates generally to pottery wheels, and, more particularly, to a miniature pottery wheel apparatus.

BACKGROUND OF THE INVENTION

Pottery wheels for manually throwing pottery typically are used for forming conventional sized pottery, such as bowls, pots, vases, and the like. Such wheels are usually more than a foot in diameter, and can support several pounds of clay or other working material. As such, prior art pottery wheel driving means are relatively large electric motors that are powered from a conventional wall outlet. Such pottery wheel apparati usually must be supported by a table or bench due to the significant weight of the electric motor, pottery wheel, and working material supported thereby. Consequently, most pottery wheel apparati are not easily portable. Further, most prior art pottery wheel apparati are not well suited to be casually carried about, such as while hiking or fishing, and are not likely to be useful unless a conventional wall outlet is nearby.

Several prior art patents, however, do teach pottery wheel apparati that are portable. For example, U.S. Pat. No. 4,028,041 to Zambrano, Jr., on Jun. 7, 1977, discloses a potter's wheel that is compact and relatively light-weight. However, such a device still requires use of a conventional wall outlet. Such a device, therefore, is not well suited for use away from a conventional outlet, such as near a lake or other relaxing natural environment. Therefore, devices of this type do not allow the user to take advantage of the relaxing, therapeutic effects of working pottery in a natural setting.

Forming pottery of any size is quite relaxing and, as such, is useful for therapeutic applications. Miniature pottery, while not used as is conventionally sized pottery, is often used in doll houses and other miniature settings. Miniature pottery, due it its relatively smaller radius, is not subject to the same degree of inertial force as larger pottery, so rotational speeds up to 10,000 rpm may be used to create such miniature pottery. However, prior art pottery wheels rotate too slowly for easily making miniature pottery. A further drawback of prior art devices is that the size of the pottery wheel is too large for conveniently creating miniature pottery. A large pottery wheel provides no safe place to rest one's hands while performing the minute and delicate forming operations necessary for throwing miniature pottery. Further, such a large pottery wheel is unsafe at rotational speeds needed for producing for miniature pottery. The circumferential edge of a larger pottery wheel reaches tremendous speeds when such a wheel is spinning upwards of 5,000 rpm.

Clearly, then, there is a need for a pottery wheel apparatus that is extremely portable, light-weight, and not dependent upon proximity to a conventional wall outlet. Such a needed device would be well-suited and safe for forming miniature pottery, and would allow the user to take advantage of the relaxing effects of forming pottery while being in a natural environment, if desired. Such a needed device would be extremely simple to manufacture, clean, and maintain, due to its relative size and simplicity, and would require no complex belt clutch means, pulley systems, or other complicated machine elements found in the prior art devices. Such a needed device would easily fit in a back-pack, be carried by hand, or the like. The present invention fulfills these needs and provides further related advantages.

SUMMARY OF THE INVENTION

The present invention is an apparatus for forming miniature pottery. A pottery wheel has a diameter no larger than two inches and rotates about a vertical axis. The wheel has a facing flat surface for supporting the miniature pottery. A drive means is coupled to the wheel for rotating the wheel about the axis at an adjustable rotational speed of between 200 and 10,000 revolutions per minute. Preferably a support base contains the drive means, and further includes a portable power source, such as a battery, interconnected to the drive means. The wheel extends above the base, and further includes a disk shaped platform and a support shaft. The platform is disengagable from the shaft so that a replacement platform may be engaged with the shaft. This allows a platform with a pottery to be removed from the apparatus and replaced with the replacement platform. The platform may further include a clay preform attached to the surface of the platform which, when the platform is coupled to the drive means, allows the preform to be thrown into a pot without expending the time and effort required to center and excavate the pot on the platform. The apparatus is preferably small and light weight enough so that it may be supported by a hand and easily carried.

A switch is preferentially included that breaks the circuit between the drive means and the power source, thereby allowing manual braking of the wheel for slowing the rotation of the wheel. The switch may then be reconnected to resume wheel rotation speed. A vibrational means is further included that produces lateral vibrational excursions of the platform. The vibration means allows special effects to be molded into the pot by producing lateral pot movements while the pot is rotating.

The present invention is extremely portable, light-weight The present apparatus easily fits in a back-pack, or the like. As such, the present invention is well suited for forming miniature pottery, and allows the user to take advantage of the relaxing effects of forming pottery almost anywhere. The present invention is also safe to use, as the size of the wheel allows the user to rest his hands on the support base 50 while performing the delicate forming operations necessary for throwing miniature pottery. Further, the present invention is battery powered, thereby not being dependent upon proximity to a conventional wall outlet and being safer for children to use. Moreover, the present invention allows for creating special effects in the pottery, and for easily controlling the rotational speed and vibrational effects of the wheel 10. The present device, therefore, not only enables one to create miniature pottery, but it allows for a wide degree of creative expression in the formation thereof. Further, the present invention is extremely easy to manufacture, clean, and maintain, due to its relatively smaller size and uncomplicated design. The present invention does not require the use of complex drive mechanisms or clutches found in the prior art. Further, no special mechanisms is required to disengaged the wheel 10 from the drive means 40, as the wheel 10 may be rotated manually quite easily even with the wheel engaged to the drive means 40. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
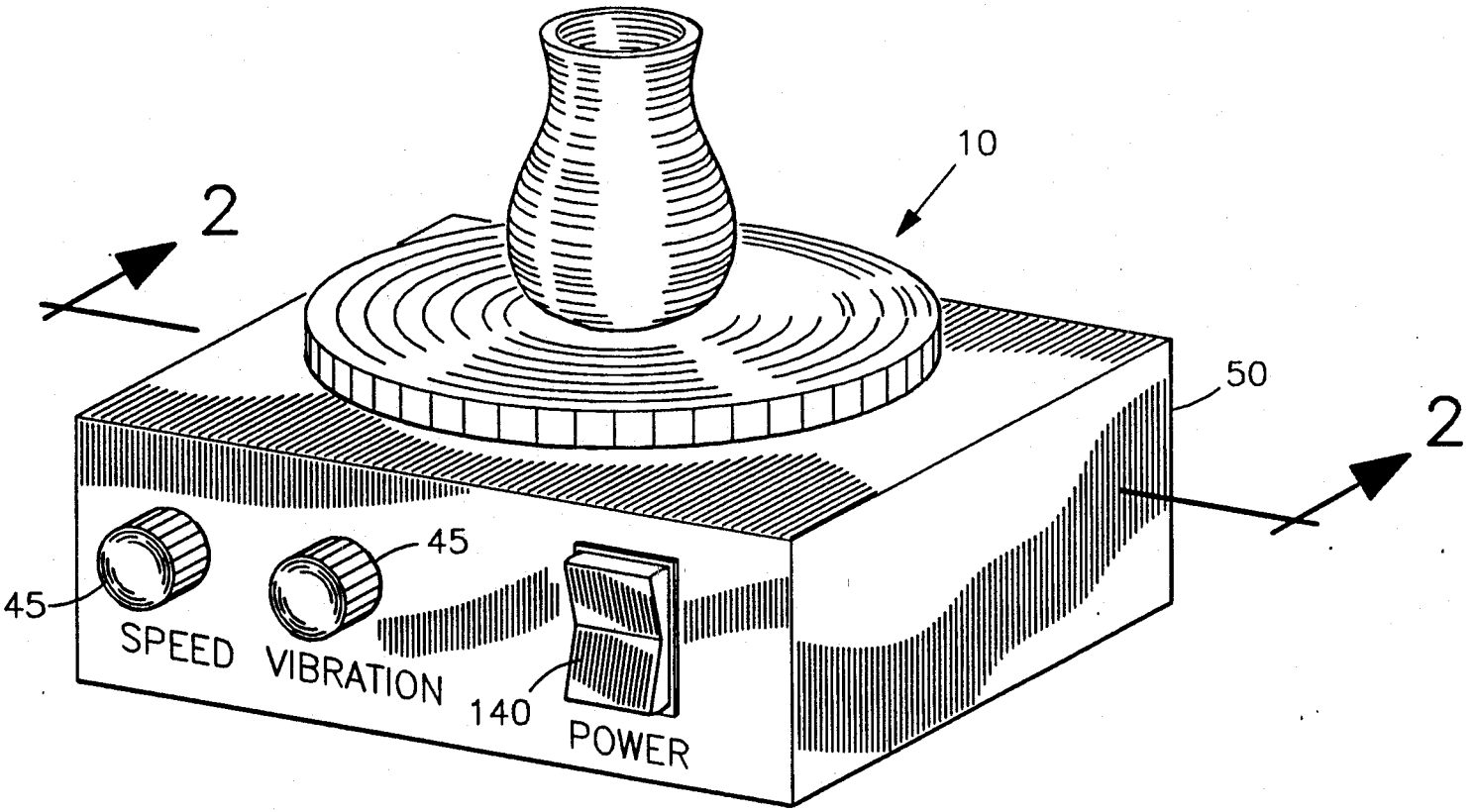
FIG. 1 is a perspective illustration of the invention, illustrating a miniature pot on a rotating pottery wheel of the invention.
Figure 2:
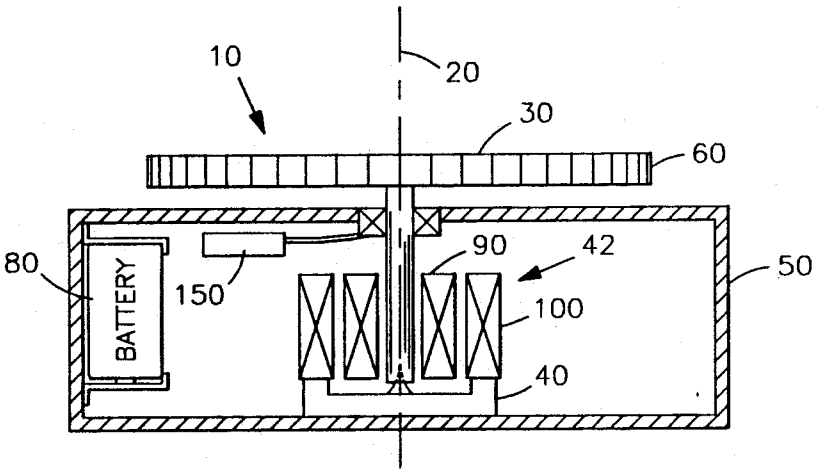
FIG. 2 is a cross sectional view of the invention, taken generally along lines 2—2 of FIG. 1, illustrating a power source and a rotational drive means of the invention.

FIGS. 1 and 2 show an apparatus for forming, also known as throwing, a miniature pot. A pottery wheel 10 has a diameter no larger than two inches and rotates about a vertical axis 20. The wheel 10 has an upward facing flat surface 30 for supporting the miniature pot. A drive means 40, such as an electric DC motor 42, is coupled to the wheel 10 for rotating the wheel 10 about the axis 20 at a rotational speed of between 200 and 10,000 revolutions per minute. Such rotational speeds increase the rotational momentum of the wheel 10 such that vigorous forming of the pottery may be achieved without significant slowing of the wheel rotation. As such, the wheel 10, while being relatively small, does demonstrate enough rotational momentum that additional fly wheel devices connected to the wheel 10 are not necessary. Preferably a support base 50 contains the drive means 40, and further includes a power source 80. The power source 80 is preferably a battery (FIG. 2), but may also include a solar cell, or the like (not shown). The wheel 10 extends above the base 50. The apparatus is small and light weight enough so that the apparatus may be supported by a hand and easily carried therein (not shown).

Figure 3:
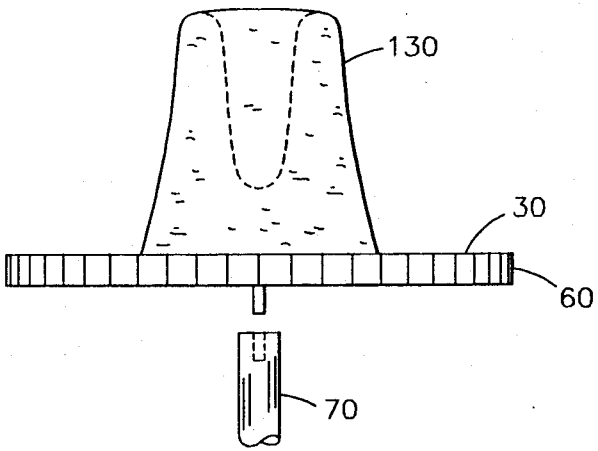
FIG. 3 is a partial left side elevational view of the invention, illustrating the pottery wheel and a clay preform of the invention.

In one embodiment of the invention, the wheel 10 includes the rotor portion 90 of an electric motor 42 and the drive means 40 contains the stator portion 100 of the electric motor 42. The stator portion 100 is rotatably engageable with the rotor portion 90 (FIG. 2). Alternately, the drive means 40 may be a belt connected to the wheel 10 (not shown). Further, the wheel 10 preferably has a disk shaped platform 60 and a support shaft 70. The platform 60 is disengagable from the shaft 70 so that a replacement platform (not shown) may be engaged with the shaft 70, allowing a platform 60 with a pot drying thereon to be removed from the apparatus and replaced with the replacement platform to enable the pot to dry before the pot is removed from the platform 60. The platform 60 may be of various sizes, preferably not exceeding 2 inches in diameter. Moreover, the platform may have various surface textures for holding the pottery to the platform 60. The platform 60 may further include a clay preform 130 (FIG. 3) attached to the surface 30 of the platform 60 which, when the platform 60 is coupled to the drive means 40, allows the preform 130 to be thrown into a pot without expending the time and effort required to center or to excavate the pot on the platform 60.

Figure 4:
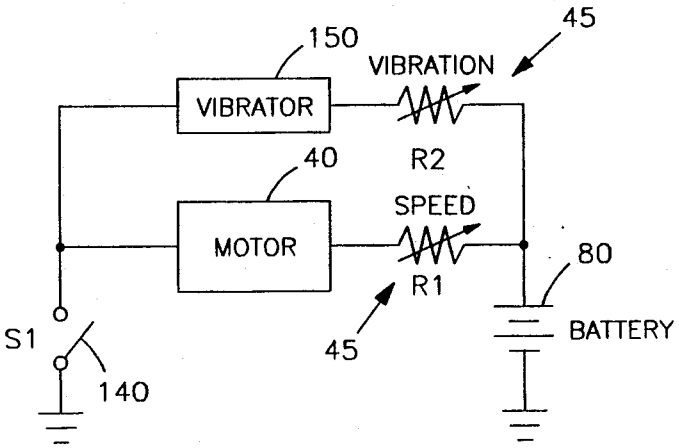
FIG. 4 is an electric schematic diagram of the electrical components of the invention.

A power interrupting means 140, such as a momentarily open switch, also preferentially included, breaks the circuit between the drive means 40 and the power source 80. This allows the wheel 10 to coast, thereby allowing manual braking of the wheel 10 for slowing wheel rotation (FIG. 4). The interrupting means 140 may then be reconnected to resume wheel rotation speed. A vibrational means 150 is further included, producing lateral vibrational excursions of the platform 60. The vibration means 150 allows special effects to be molded into the pot by producing lateral pot movements while the pot is rotating.

The base 50 is preferably made of a rigid material, such as plastic or metal. The platform surface 30 can be made with various textures or patterns in order to increase the natural adhesion of the pot to the platform 60. Optionally, a speed controller may be included to control the rotational speed of the wheel between 200 and 10,000 rpm. Such a speed controller may be a potentiometer 45 in series with the drive means 40, or, preferably, a variable voltage regulator that better conserves battery life. A vibration controller, such as a potentiometer 45 in series with the vibration means 150, may also be included to control the vibration magnitude produced by the vibration means 150.

In operation, a platform 60 with a clay preform 130 is selected and inserted into the shaft 70. Alternately, the user may select a platform 60 without a clay preform 130 and supply his own clay, or other formable material. The power interrupting means 140 is then closed, thereby causing the drive means 40 to achieve a predetermined rotational speed. Optionally, the speed may be adjusted to suite the user and the particular work the user wishes to form. The user then begins to form the clay into a miniature pot, vase, or other such work, by using various clay forming tools (not shown), or, optionally, his hands and fingers. The vibration means 150 may be activated while forming the pottery in order to produce special effects in the pottery. Upon completing the formation of the pottery, the user may then either wait for the clay to dry, possibly removing the platform 60 and inserting a replacement platform 60 so that he may continue to use the apparatus, or use a small torch to dry the clay (not shown). Additionally, he may wish to apply various paints, coatings, and textures to the pottery, either with the wheel 10 rotating or stationary, for various effects. The size of such miniature pottery allows quick drying thereof and does not require the use of a clay drying oven.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. An apparatus for throwing a miniature pot comprising:

a pottery wheel having a diameter not larger than two inches, the wheel rotating about a vertical axis and having an upwardly facing flat surface for supporting the miniature pot; and a drive means coupled to the wheel for rotating the wheel about the axis at an adjustable rotational speed, the adjustable rotational speed being a speed between 200 and 10,000 rpm, so that the miniature pot is thrown on the flat surface.

2. The apparatus of claim 1 further including a support base for containing the drive means, and further including a power source, the wheel extending above the base, the apparatus being small and light weight enough so that the apparatus is supported by a hand and easily carried therein.

3. The apparatus of claim 1 wherein the wheel includes a rotor portion of an electric motor and the drive means contains a stator portion of the electric motor, the stator portion being rotatably engageable with the rotor portion.

4. The apparatus of claim 1 wherein the wheel has a disk shaped platform and a support shaft, the platform being disengagable from the shaft so that a replacement platform is engaged with the shaft, whereby one of the platforms, said platform having a pot thereon, is removed from the apparatus and replaced with another of the platforms to enable the pot to dry before the pot is removed from the one of the platforms.

5. The apparatus of claim 4 wherein another platform further includes a clay preform, the preform being attached to the surface of the platform such that the platform with the preform is coupled to the drive means, the preform being thrown into a pot without the necessity of loosing the use of the apparatus wheel centering the excavating the preform on the platform.

6. The apparatus of claim 1 further including a means for interrupting power to the drive means while the drive means is turning to allow the wheel to coast to enable manual braking of the wheel for slowing wheel rotation, the interrupting means being reconnectable to resume wheel rotation speed.

7. The apparatus of claim 1 further including a means for producing a vibrational excursion of the platform, the excursion producing means allowing special effects to be molded into the pot by producing lateral pot movements while the pot is rotating.

* * * * *